US009814266B2

(12) United States Patent
Liu

(10) Patent No.: US 9,814,266 B2
(45) Date of Patent: Nov. 14, 2017

(54) ELECTRONIC CIGARETTE

(71) Applicant: KIMREE HI-TECH INC., Tortola (VG)

(72) Inventor: Qiuming Liu, Huizhou (CN)

(73) Assignee: SHENZHEN KIMSEN TECHNOLOGY CO., LTD., Shenzhen, Guangdong Province (CN)

( * ) Notice: Subject to any disclaimer, the term of this patent is extended or adjusted under 35 U.S.C. 154(b) by 462 days.

(21) Appl. No.: 14/388,805

(22) PCT Filed: Mar. 26, 2013

(86) PCT No.: PCT/CN2013/073223
§ 371 (c)(1),
(2) Date: Sep. 26, 2014

(87) PCT Pub. No.: WO2014/153723
PCT Pub. Date: Oct. 2, 2014

(65) Prior Publication Data

US 2016/0058072 A1 Mar. 3, 2016

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01)

(58) Field of Classification Search
None
See application file for complete search history.

(56) References Cited

U.S. PATENT DOCUMENTS 3,262,613 A * 7/1966 Miller ..... B65D 47/283 222/522
4,569,136 A 2/1986 Loring
4,638,820 A 1/1987 Roberts et al.
(Continued)

FOREIGN PATENT DOCUMENTS

CN 1133420 A 10/1996
CN 2450912 Y 10/2001
CN 201153511 Y 11/2008
(Continued)

OTHER PUBLICATIONS

English translation of Zhu (CN 2450912), no date.*

*Primary Examiner* — Michael H Wilson
*Assistant Examiner* — Katherine Will
(74) *Attorney, Agent, or Firm* — Cheng-Ju Chiang

(57) ABSTRACT

The present invention provides an electronic cigarette, including an inhalation rod and a battery rod. The inhalation rod includes a cartridge and an atomizer disposed in the cartridge operable to produce aerosol; wherein one end of the inhalation rod is embedded with a mouthpiece cover, and a through-hole of the mouthpiece cover is removably embedded with an air valve serving as a switch for an inhalation port of aerosol passage. The electronic cigarette of the embodiment of the present invention, by using the technical means of in the through-hole of the mouthpiece cover removably embedded the air valve serving as the switch for the inhalation port of aerosol passage, making the electronic cigarette no longer available for smoking right after taking in mouth, then effectively prevents infant smoking by mistake like a toy.

15 Claims, 6 Drawing Sheets

(56) References Cited

U.S. PATENT DOCUMENTS

| | | | | |
|---|---|---|---|---|
| 8,499,766 | B1 * | 8/2013 | Newton | A24F 47/008 131/273 |
| 2013/0192623 | A1 * | 8/2013 | Tucker | H01C 17/00 131/329 |

FOREIGN PATENT DOCUMENTS

| | | | |
|---|---|---|---|
| CN | 202618275 | U | 12/2012 |
| CN | 203243940 | U | 10/2013 |
| WO | 2011/117580 | A2 | 9/2011 |

* cited by examiner

ELECTRONIC CIGARETTE

CROSS REFERENCE TO RELATED APPLICATIONS

The present application is a 35 U.S.C. §371 National Phase conversion of International (PCT) Patent Application No. PCT/CN2013/073223, filed on Mar. 26, 2013, the disclosure of which is incorporated by reference herein. The PCT International Patent Application was filed in Chinese.

FIELD OF THE INVENTION

The present invention relates to electronic cigarettes.

BACKGROUND OF THE INVENTION

Electronic cigarette is a simulation cigarette, using a heating wire to heat and vaporize fragrance-containing materials to produce aerosol for users smoking. However, conventional electronic cigarette is available for smoking right after taking in mouth, then easy to cause infant smoking by mistake.

SUMMARY OF THE INVENTION

An objective of the present invention provides an electronic cigarette capable of preventing infant smoking by mistake.

To achieve the aforementioned objective, the present invention provides an electronic cigarette, including an inhalation rod and a battery rod. The inhalation rod includes a cartridge and an atomizer disposed in the cartridge operable to produce aerosol; wherein one end of the inhalation rod is embedded with a mouthpiece cover, and a through-hole of the mouthpiece cover is removably embedded with an air valve serving as a switch for an inhalation port of aerosol passage. Therefore, by using the air valve, the electronic cigarette is no longer available for smoking right after taking in mouth, which effectively prevents infant smoking by mistake like a toy.

Furthermore, as an embodiment, the air valve includes a bottom seat and a plurality of columns disposed at a first side of the bottom seat, the columns defines gaps therebetween to coordinately form a ventilation groove for aerosol flowing. The gaps make the air valve easy to install. When one end of the column is pressed, there is space relative to near the deformation and then facilitate the air valve to be inserted into the through-hole of the mouthpiece cover. Preferably, the bottom seat and the column are integral forming structure, the structure is simple and practical, convenient for using.

Furthermore, a bottom of the ventilation groove is formed by a partial side of the first side. Specifically, the projection of the cross section of the ventilation groove relative to the side of a first side of the bottom seat locates in the side of the first side. The projection extending outwards from the side of the first side forms a sealing part operable to seal, which guarantees a tightness of the air valve when closed.

Furthermore, preferably the number of columns is two, the cross-section of the column is arcuate, planar surfaces of the two columns are opposite to each other and the two columns are symmetrical disposed.

Furthermore, as an alternative embodiment, the air valve includes a bottom seat and a column disposed at a first side of the bottom seat; the column axially disposes a cavity therein; a distal end of the column radially disposes an air vent therein; the air vent communicates with the aerosol passage in the inhalation rod and the cavity; the first side of the bottom seat disposes a groove therein; the groove is formed by the cavity extending into the first side and extending toward the second side of the bottom seat; the groove makes the cavity communicating to outside. The groove structure makes the ventilation groove still capable to ventilate with outside after pressing the air valve, then guarantees the ventilation smoothness.

Furthermore, a wall of the through-hole of the mouthpiece cover extends inward to form a sidewall; the sidewall blocks the air vent when pulling out the air valve, and exposes the air vent when pressing the air valve. Therefore, matching of the air vent and the sidewall forms a switch structure, guaranteeing the smooth flow between the aerosol passage and the outside after pressing the air valve.

Furthermore, a distal end of the column extends outward to form a stopping part capable of preventing the air valve escaping from the through-hole of the mouthpiece cover. The stopping part is barb-shaped, then effectively to prevent the air valve escaping from the through-hole of the mouthpiece cover by excessive force. A distal end of the stopping part is gradually larger toward the direction of the bottom seat, then facilitate to be inserted into the through-hole of the mouthpiece cover.

Furthermore, t the bottom seat is truncated cone-shaped, and a diameter of the first side opposite to the mouthpiece cover is smaller than a diameter of the second side. Therefore, the cone is small and compact, and a slanted surface structure of the cone gradually sloping from inside to outside makes it easy for adult users to use fingers to pull out the air valve, and the operation is easy. However, infant's fingers are often clumsy and it is not easy to pull out the air valve. The second side of the bottom seat is planar structure, facilitating users to press the air valve.

Furthermore, the inhalation rod further comprises a first connector disposed at the other end of the cartridge and used to connect with the battery rod.

Furthermore, the battery rod includes a battery tube and a battery disposed in the battery tube; one end of the battery tube disposes a second connector matching and abutting with the first connector, the other end of the battery tube disposes a switch module and a light cap assembly.

Furthermore, both the first connector and the second connector are formed by an outer electrode ring, an insulation ring and an inner electrode in turn nested.

Furthermore, the atomizer includes an atomization chamber composed of a liquid-storage piece and a catheter which are in turn nested, and of which two ends are sealed, and a heater disposed in the atomization chamber; two ends of the atomization chamber are sealed by a liquid-blocking seat and the outer electrode ring respectively.

Furthermore, the heater includes a liquid-guiding piece of which two ends extend out of an outer sidewall of the catheter and mutually abuts with the liquid-storage piece, and a heating wire winding on an outer surface of the liquid-storage piece; two ends of the heating wire are electrically connected to the inner electrode and the outer electrode ring respectively.

The advantage of the present invention are: by using the technical means of the through-hole of the mouthpiece cover removably embedded the air valve serving as the switch for the inhalation port of aerosol passage makes the electronic cigarette no longer available for smoking right after taking in mouth, then effectively prevents infant smoking by mistake like a toy.

DETAILED DESCRIPTION OF THE INVENTION

It is needed to state that embodiments and all element limitations in all embodiments may be combined in the case of no conflicts. The present invention will be described in detail in the following combining figures and embodiments.

Figure 1:
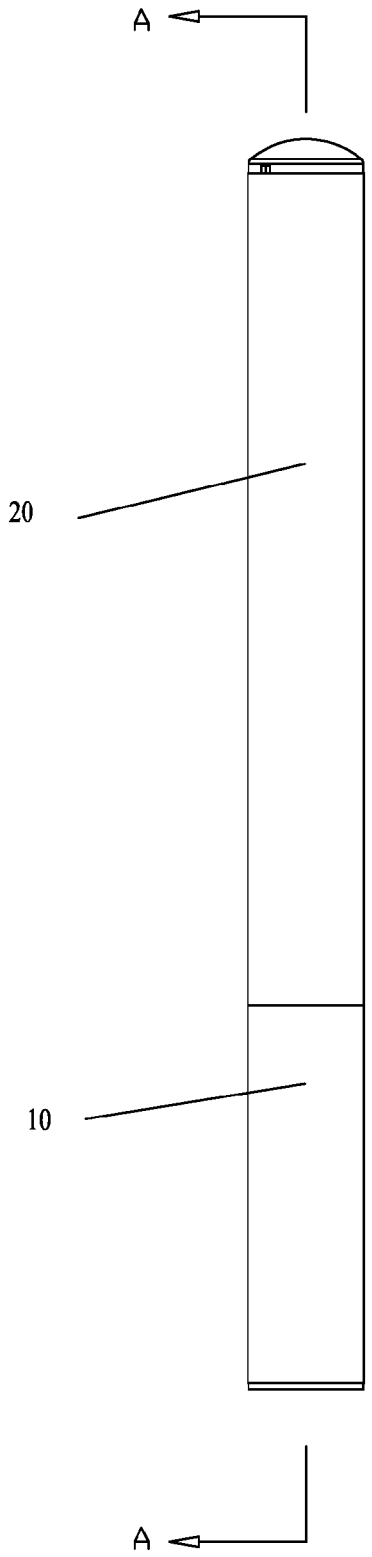
FIG. 1 is a schematic view of a whole structure of an electronic cigarette according to an embodiment of the present invention.
Figure 2:
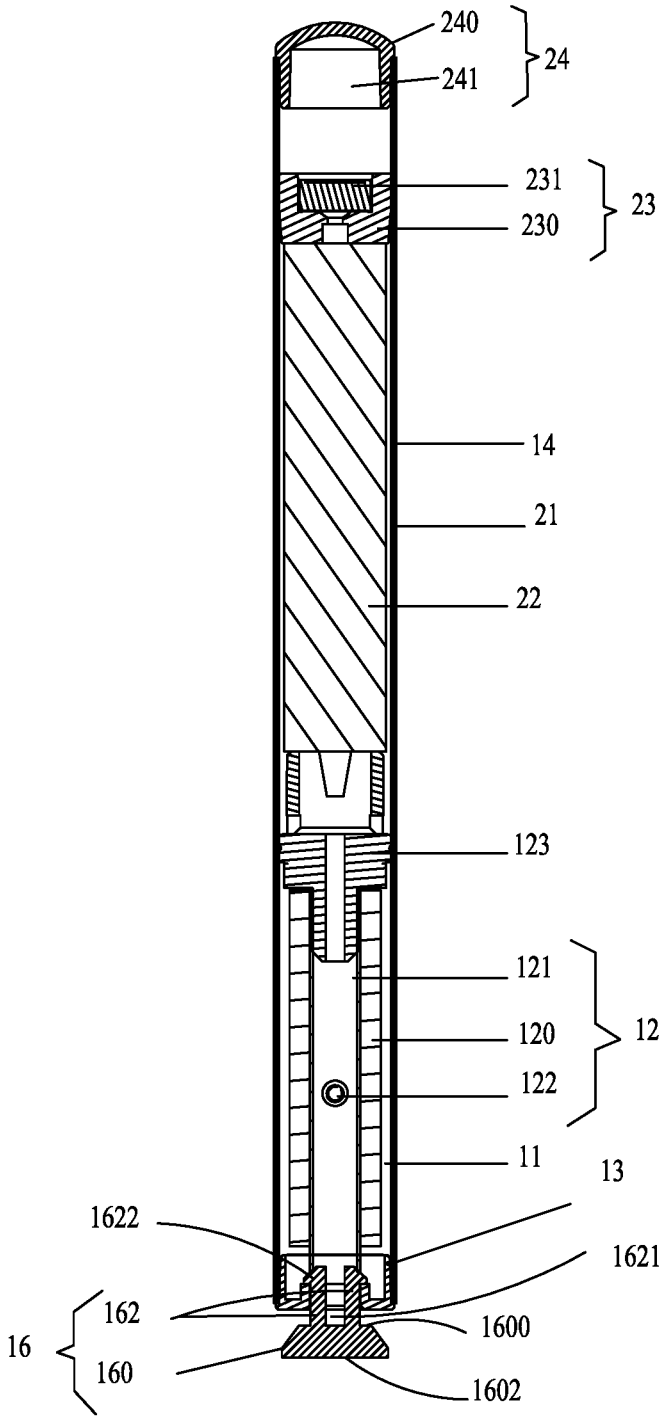
FIG. 2 is a side sectional view along line A-A of the electronic cigarette shown in FIG. 1.
Figure 3:
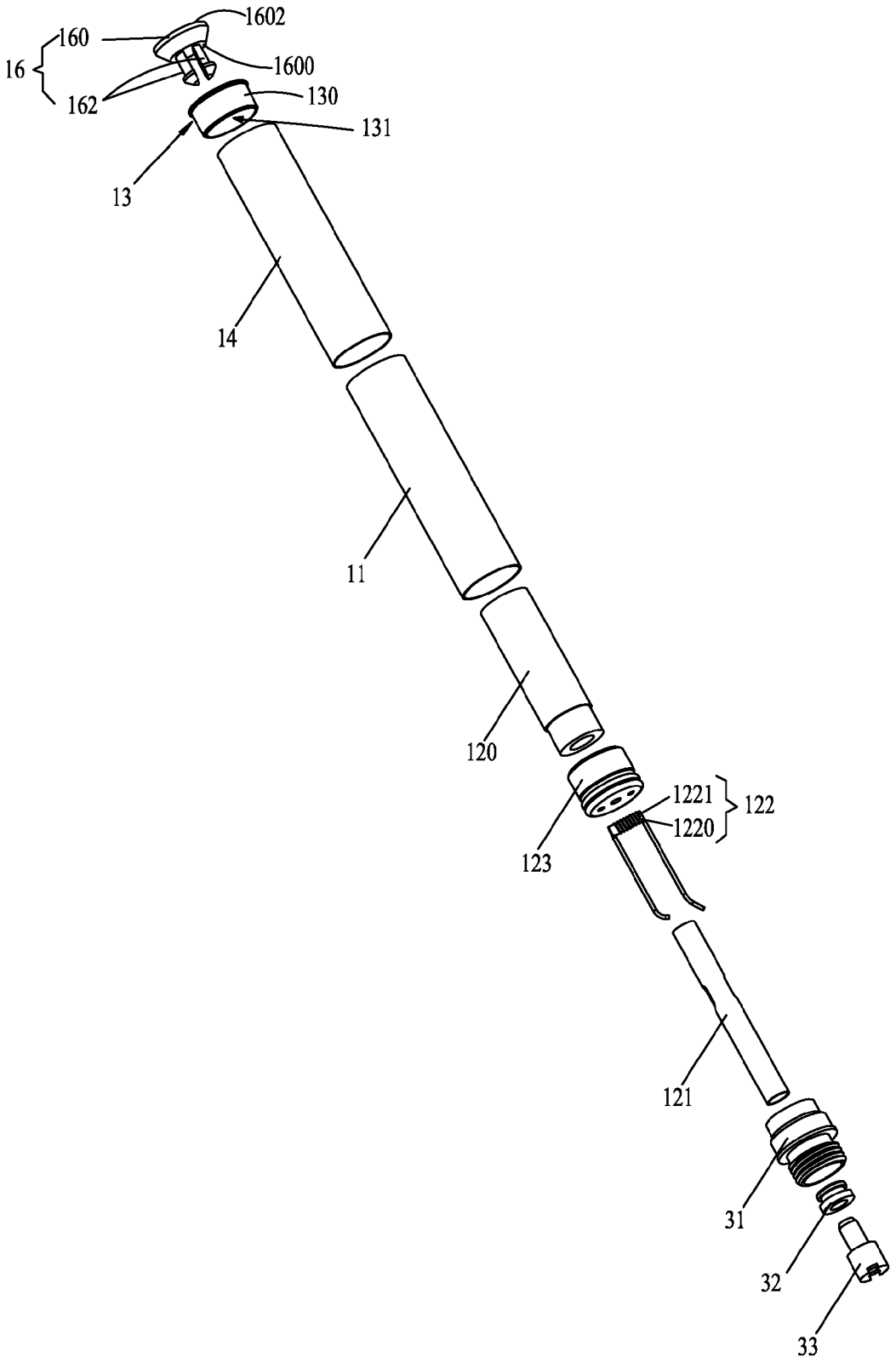
FIG. 3 is an exploded view of the electronic cigarette according to the embodiment of the present invention.
Figure 4:
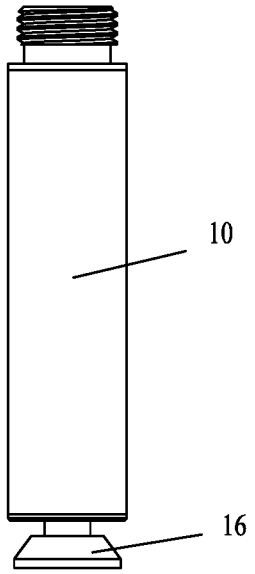
FIG. 4 is a schematic view of a first state of the electronic cigarette according to the embodiment of the present invention.
Figure 5:
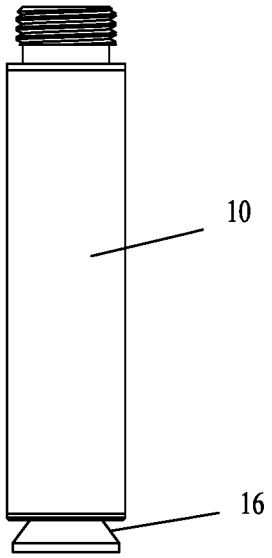
FIG. 5 is a schematic view of a second state of the electronic cigarette according to the embodiment of the present invention.
Figure 6:
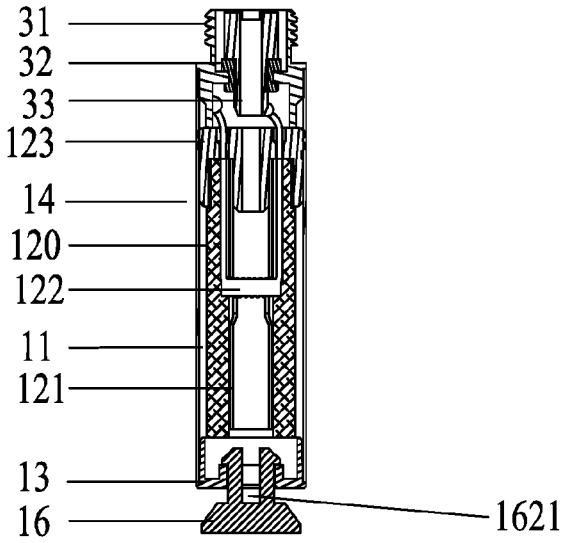
FIG. 6 is a schematic view of an air valve in an opening state of the electronic cigarette according to a first embodiment of the present invention.
Figure 7:
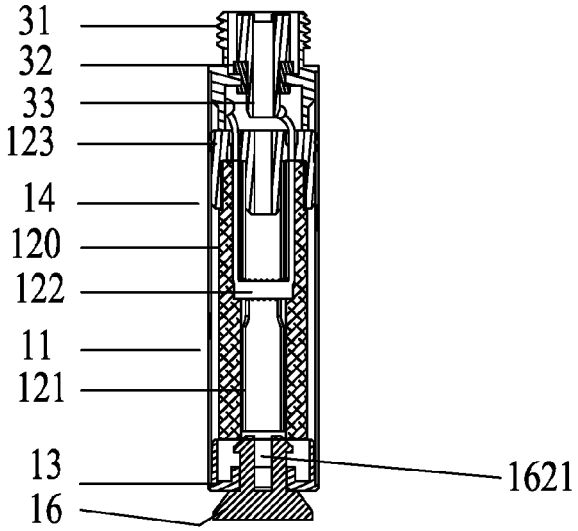
FIG. 7 is a schematic view of the air valve in a closing state of the electronic cigarette according to the first embodiment of the present invention.
Figure 8:
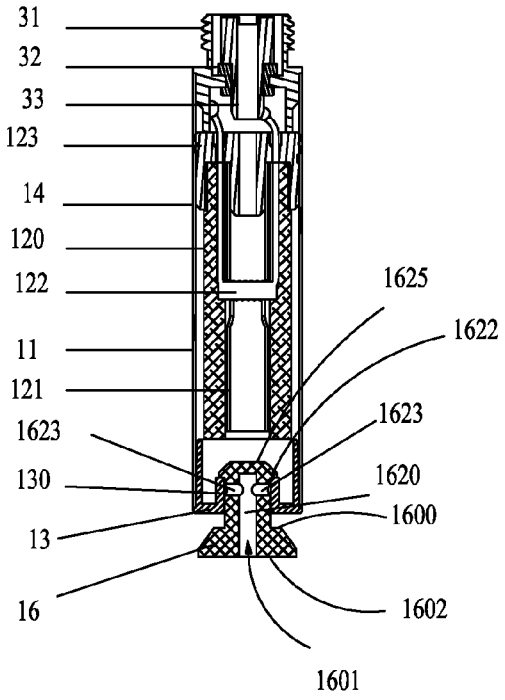
FIG. 8 is a schematic view of an air valve closing of an electronic cigarette according to a second embodiment of the present invention.
Figure 9:
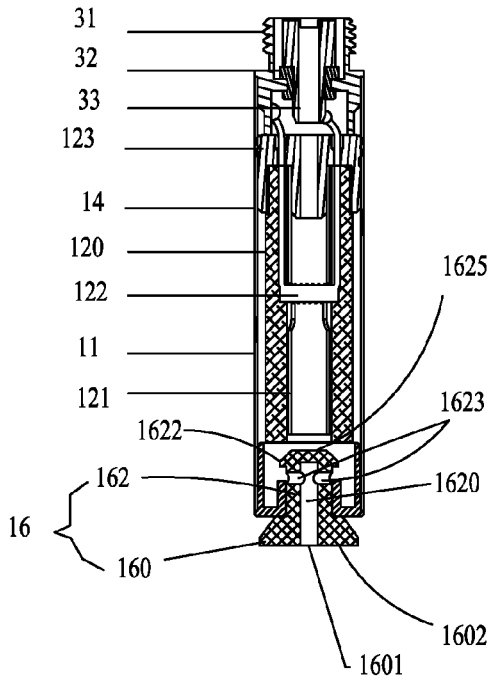
FIG. 9 is a schematic view of the air valve in an opening state of the electronic cigarette according to the second embodiment of the present invention.

Referring to FIG. 1 to FIG. 3, the present invention provides an electronic cigarette capable of preventing infant smoking by mistake, no smoking will happen when infants taking the electronic cigarette in mouth for fun. The electronic cigarette includes an inhalation rod 10 and a battery rod 20 which are mutually abutted with.

The inhalation rod 10 includes a cartridge 11, an atomizer 12 disposed in the cartridge 11 and used to produce aerosol, a mouthpiece cover 13 embedded in one end of the cartridge 11, and a first connector disposed at the other end of the cartridge 11 to connect with the battery rod 20. In the embodiment, an outer surface of the cartridge 11 is sheathed with a sticker 14 for decoration and protective effect.

The cartridge 11 is barrel-shaped. A through-hole 131 of the mouthpiece cover 13 is actively, or detachably embedded with an air valve 16 serving as a switch for an inhalation port of aerosol passage. The air valve 16 includes a bottom seat 160 and a plurality of columns 162 disposed at a first side 1600 of the bottom seat 160. The columns 162 defines gaps therebetween to coordinately form a ventilation groove 1621 for aerosol flowing. Preferably, the bottom seat 160 and the column 162 are integral forming structure.

The bottom seat 160 is truncated cone-shaped, and a diameter of a first side 1600 opposite to the mouthpiece cover 13 is smaller than that of a second side 1602 back to the first side 1600. Therefore, the cone is small and compact, and a slanted surface structure of the cone, gradually sloping from inside to outside, makes it easy for adult users to use fingers to pull out the air valve 16, and the operation is easy. However, infant's fingers are often clumsy and it is not easy to pull out the air valve 16. The second side 1602 of the bottom seat 160 is planar structure, facilitating users to press the air valve 16.

A distal end of the column 162 extends outwardly to form a stopping part 1622 capable of preventing the air valve 16 escaping from the through-hole of the mouthpiece cover 13. The stopping part 1622 is barb-shaped, then effectively to prevent the air valve escaping from the through-hole of the mouthpiece cover 13 by excessive force. A size of a distal end of the stopping part 1622 is gradually larger toward the direction of the bottom seat 160, then facilitate to be inserted into the through-hole of the mouthpiece cover 13. There are two columns 162, and the cross-sections of the columns are arcuate. Planar surfaces of the two columns 162 are opposite to each other and the two columns are symmetrical disposed.

Referring to FIG. 4 to FIG. 7, as a first embodiment, pulling out the air valve 16, the electronic cigarette is in ventilation state (as a first state shown in FIG. 4 and FIG. 6), it is available for user to smoke the electronic cigarette. Pressing the air valve 16, the electronic cigarette is in blocking state (as a second state shown in FIG. 5 and FIG. 7), it is unavailable to smoke the electronic cigarette. Specifically, a bottom of the ventilation groove 1621 is formed by a partial side of the first side 1600. The projection of the cross section of the ventilation groove 1621 relative to the side of the first side 1600 of the seat 160 locates in the side of the first side 1600. The projection extending outwards from the side of the first side 1600 forms a sealing part operable to seal, which guarantees a tightness of the air valve 16 when closed.

Referring to FIG. 4, FIG. 5, FIG. 8 and FIG. 9, as a second embodiment, pulling out the air valve 16, the electronic cigarette is in blocking state (as a first state shown in FIG. 4 and FIG. 8), it is unavailable to smoke the electronic cigarette; pressing the air valve 16, the electronic cigarette is in ventilation state (as a second state shown in FIG. 5 and FIG. 9), it is available for smoking the electronic cigarette. Specifically, the air valve 16 includes the bottom seat 160 and the column 162 disposed at the first side 1600 of the bottom seat 160. The column 162 axially disposes a cavity 1620 therein. A distal end 1625 of the column 162 radially disposes a pair of air vents 1623 through an annular sidewall of the column 162 in a diametrical direction. The air vents 1623 communicate with the aerosol passage in the inhalation rod 10 and the cavity 1620. The second side 1602 of the bottom seat 160 axially disposes a groove 1601 therethrough. The groove 1601 is formed by the cavity 1620 extending into the first side 1600 and extending toward the second side 1602 of the seat 160. The groove 1601 makes the cavity 1620 communicating to outside. Structure of the groove 1601 makes the ventilation groove 1621 still capable to ventilate with outside after pressing the air valve 16, then guarantees the ventilation smoothly. And, a wall of the through-hole of the mouthpiece cover 13 extends inward to form an annular sidewall 130 with the through-hole 131 in center. The sidewall 130 blocks the air vents 1623 when pulling out the air valve 16, and exposes the air vents 1623 when pressing the air valve 16. Therefore, the cooperation of the ventilation hole 1623 and the sidewall forms a switch structure, which guarantees the smoothly flow between the aerosol passage and the outside after pressing the air valve 16.

The atomizer 12 includes an atomization chamber composed of a liquid-storage piece 120 and a catheter 121 which are in turn nested, and of which two ends are sealed, and a heater 122 disposed in the atomization chamber. Two ends of the atomization chamber are sealed by a liquid-blocking seat 123 and an outer electrode ring 31 respectively. The heater 122 includes a liquid-guiding piece 1220, of which two ends extend out of an outer sidewall of the catheter 121 and mutually abut with the liquid-storage piece 120, and a heating wire 1221 being wound around the liquid-guiding piece 1220. Two ends of the heating wire 1221 are electrically connected to an inner electrode 33 and the outer electrode ring 31 respectively. In the embodiment, the liquid-storage piece 120 is a liquid-storage cotton, and the catheter 121 is a fiberglass tube, and the liquid-guiding piece 1220 is a liquid-guiding wick.

Referring to FIG. 2, the battery rod 20 includes a battery tube 21 and a battery 22 disposed in the battery tube 21. One end of the battery tube 21 disposes a second connector matching and abutting with the first connector, and the other end of the battery tube 21 disposes a switch module 23 and a light cap assembly 24. The switch module 23 includes a supporting seat 230 and an airflow sensor 231 fixed on the supporting seat 230. The light cap assembly 24 includes a light cap 240 and a LED light 241 disposed in the inside, and being red, and used to simulate burning cigarette to indicate state.

Both the first connector and the second connector are formed by the outer electrode ring 31, an insulation ring 32 and the inner electrode 33 in turn nested. The insulation ring 32 is used for the insulation between the outer electrode ring 31 and the inner electrode 33.

Embodiments of the present invention is shown and described in the above-mentioned. Various improvement and modifications can be made to the embodiments by those skilled in the art without departing from the true spirit and scope of the disclosure. The scope of the present invention is defined by the appended claims and equivalents thereof.

What is claimed is:

1. An electronic cigarette, comprising an inhalation rod and a battery rod; the inhalation rod comprising a cartridge and an atomizer disposed in the cartridge operable to produce an aerosol; wherein one end of the inhalation rod is embedded with a mouthpiece cover, and a through-hole of the mouthpiece cover is movably embedded with an air valve serving as a switch for an inhalation port of an aerosol passage;

the air valve includes a bottom seat and a plurality of columns disposed at a first side of the bottom seat opposite to the mouthpiece cover, the columns define gaps therebetween to coordinately form a ventilation groove for flowing an aerosol, the ventilation groove communicates with the aerosol passage in the inhalation rod; and in a ventilation state, the air valve is pulled out, the gaps between the columns are exposed to the outside for the user to smoke the aerosol flowing from the gaps between the columns under the bottom seat; or in a blocking state, the air valve is pressed downwards and a sidewall of the mouthpiece cover blocks the gaps between the columns, and it is unavailable to smoke the electronic cigarette.

2. According to the electronic cigarette in claim 1, wherein a bottom of the ventilation groove is formed by a partial side of the first side.

3. According to the electronic cigarette in claim 1, wherein the number of columns is two, the cross-section of the column is arcuate, planar surfaces of the two columns are opposite to each other and the two columns are symmetrically disposed.

4. According to the electronic cigarette in claim 1, wherein a distal end of the column extends outward to form a stopping part capable of preventing the air valve escaping from the through-hole of the mouthpiece cover.

5. According to the electronic cigarette in claim 1, wherein the bottom seat is truncated cone-shaped, and a diameter of the first side opposite to the mouthpiece cover is smaller than a diameter of the second side back to the first side; whereby in the blocking state, it is not easy to pull out the air valve.

6. According to the electronic cigarette in claim 1, wherein the inhalation rod further comprises a first connector disposed at the other end of the cartridge and used to connect with the battery rod.

7. According to the electronic cigarette in claim 6, wherein the battery rod includes a battery tube and a battery disposed in the battery tube; one end of the battery tube disposes a second connector matching and abutting with the first connector, the other end of the battery tube disposes a switch module and a light cap assembly.

8. According to the electronic cigarette in claim 7, wherein both the first connector and the second connector are formed by an outer electrode ring, an insulation ring and an inner electrode in turn nested.

9. According to the electronic cigarette in claim 8, wherein the atomizer includes an atomization chamber comprising a liquid-storage piece and a catheter which are in turn nested, and a heater disposed in the atomization chamber; two ends of the atomization chamber are provided with a liquid-blocking seat and the outer electrode ring respectively.

10. According to the electronic cigarette in claim 9, wherein the heater includes a liquid-guiding piece of which two ends extend out of an outer sidewall of the catheter and mutually abut with the liquid-storage piece, and a heating wire winding on an outer surface of the liquid-guiding piece; two ends of the heating wire are electrically connected to the inner electrode and the outer electrode ring respectively.

11. According to the electronic cigarette in claim 1, wherein the bottom seat and the column are an integral forming structure.

12. According to the electronic cigarette in claim 4, wherein the stopping part is barb-shaped, and a size of a distal end of the stopping part is gradually larger toward the direction of the bottom seat.

13. An electronic cigarette, comprising:

an inhalation rod, the inhalation rod comprising a cartridge, and an atomizer disposed in the cartridge;

a battery rod abutted with the inhalation rod;

a mouthpiece cover disposed in one end of the inhalation rod and defining a though-hole; and a switch being actively disposed in the mouthpiece cover, and configured for an inhalation port of aerosol passage;

wherein the switch is an air valve, the air valve includes a bottom seat and a column disposed at a first side of the bottom seat opposite to the mouthpiece cover; the column axially defines a cavity therein; a distal end of the column radially defines a pair of air vents through a sidewall of the column in a diametrical direction; the air vent communicates an aerosol passage in the inhalation rod with the cavity; the bottom seat axially defines a groove therethrough; the groove is formed by the cavity axially extending from the first side toward the second side of the bottom seat the groove makes the cavity communicating with the outside;

a structure of the groove makes the ventilation groove still capable of ventilating with the outside after pressing the air valve, then guarantees the ventilation smoothly;

a wall of the through-hole of the mouthpiece cover extends inward to form a sidewall;

the sidewall of the mouthpiece cover is capable of blocking the air vent when pulling out the air valve, and is capable of exposing the air vent to the aerosol passage in the inhalation rod when pressing the air valve downwards; whereby the cooperation of the ventilation hole and the sidewall of the mouthpiece cover forms a switch structure, which guarantees the smoothly flow between the aerosol passage and the outside after pressing the air valve.

14. According to the electronic cigarette in claim 13, wherein a bottom of the ventilation groove is formed by a partial side of the first side.

15. According to the electronic cigarette in claim 13, wherein a distal end of the column extends outward to form a stopping part capable of preventing the air valve escaping from the through-hole of the mouthpiece cover.

* * * * *